US012479632B2

(12) United States Patent
Lin

(10) Patent No.: US 12,479,632 B2
(45) Date of Patent: Nov. 25, 2025

(54) LID STRUCTURE

(71) Applicant: Shenzhen Zhongmin Technology Co., Ltd., Guangdong (CN)

(72) Inventor: Yitong Lin, Guangdong (CN)

(73) Assignee: Shenzhen Zhongmin Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/645,367

(22) Filed: Apr. 24, 2024

(65) Prior Publication Data

US 2025/0145343 A1 May 8, 2025

(30) Foreign Application Priority Data

Nov. 8, 2023 (CN) ..... 202311480704.9

(51) Int. Cl.
*B65D 47/06* (2006.01)
*B65D 51/18* (2006.01)
*B65D 51/24* (2006.01)

(52) U.S. Cl.
CPC ..... *B65D 47/066* (2013.01); *B65D 51/18* (2013.01); *B65D 51/242* (2013.01); *B65D 2251/0025* (2013.01); *B65D 2251/005* (2013.01)

(58) Field of Classification Search
CPC .... B65D 47/066; B65D 51/18; B65D 51/242; B65D 2251/0025; B65D 2251/005; A47G 19/2272
See application file for complete search history.

(56) References Cited

U.S. PATENT DOCUMENTS 2,893,612 A * 7/1959 Akers ..... B65D 47/066 222/536
5,203,468 A * 4/1993 Hsu ..... B65D 47/2037 222/530
10,455,959 B2 * 10/2019 Coon ..... B65D 47/0871
2012/0187075 A1 * 7/2012 El-Saden ..... B65D 51/242 215/389

FOREIGN PATENT DOCUMENTS

EP 3009053 A1 * 4/2016 ..... A45F 3/16

* cited by examiner

*Primary Examiner* — James N Smalley

(57) ABSTRACT

Disclosed is a lid structure. An upper lid of the lid structure is buckled to a main lid, the upper lid is provided with an opening for a straw to extend out, a locking assembly is disposed between the main lid and the upper lid, and when the straw is bent, the locking assembly can move along a radial direction of the main lid to be inserted and locked in an inner hole in an end portion of the straw, so that water leakage can be avoided when the straw is bent. Due to the fact that when the straw is bent, the locking assembly can move along the radial direction of the main lid to be inserted and locked in the inner hole in the end portion of the straw, the straw is prevented from getting upright due to the bouncing force thereof to result in water leakage.

9 Claims, 10 Drawing Sheets

LID STRUCTURE

CROSS REFERENCES TO RELATED APPLICATION

The present application claims the benefit of Chinese Patent Application No. 202311480704.9 filed on Nov. 8, 2023, the contents of which are incorporated herein by reference in their entirety.

TECHNICAL FIELD

The present disclosure relates to the technical field of manufacturing of water bottles, in particular to a lid structure for water bottle.

BACKGROUND ART

Currently, most of lids of water bottles on the market have small drinking spouts, while for a wide-mouth water bottle with a wide drinking spout, a lid and a body are simply screwed through threads, which is not easy to use by users.

SUMMARY OF THE INVENTION

The present disclosure aims to provide a lid structure to solve the technical problem that current wide-mouth water bottles are not convenient to use by users.

In order to solve the above problem, according to one aspect of the present application, an embodiment of the present disclosure provides a lid structure. The lid structure includes: a main lid provided with a straw;

an upper lid buckled to the main lid, the upper lid being provided with an opening for the straw to extend out; and a locking assembly disposed between the main lid and the upper lid, wherein when the straw is bent, the locking assembly is capable of moving along a radial direction of the main lid to be inserted and locked in an inner hole in an end portion of the straw, and the locking assembly is moved out of the inner hole in the end portion of the straw when pressed.

In some implementations, the locking assembly includes a puller, a locking pin and a first elastic member, the puller is rotatably disposed on an outer wall of the main lid, the locking pin is disposed between the main lid and the upper lid in a radially movable manner, one end of the locking pin penetrates out of the main lid and rotatably connected to the puller, and the first elastic member is disposed between the puller and the main lid to drive the locking pin to move inward along the radial direction.

In some implementations, the main lid is provided with a protective structure, and the protective structure is disposed around the puller; and/or, a safety latch is further disposed between the main lid and the upper lid, the safety latch is provided with a toggle protrusion protruding out of the upper lid, and the locking pin is provided with a locking hole for the safety latch to be inserted and locked when the straw is bent.

In some implementations, the safety latch is provided with a toggle point, the main lid is provided with a first toggle point groove and a second toggle point groove, the toggle point is located in the first toggle point groove when the safety latch is withdrawn from the locking hole, and the toggle point is located in the second toggle point groove when the safety latch is inserted in the locking hole.

In some implementations, a tubular member is disposed at the end portion of the straw, a first rotating shaft is disposed on an outer wall of the tubular member, the main lid is provided with a first supporting portion extending to the upper lid, an end portion of the first supporting portion and/or the upper lid is provided with a first mounting groove for the first rotating shaft to be inserted, and when the straw is bent, the locking pin is able to be inserted and locked in an inner hole in an end portion of the tubular member.

In some implementations, a toggle convex edge protruding outward in a radial direction is disposed on an outer wall of the tubular member away from the locking assembly, and the toggle convex edge is located outside the opening.

In some implementations, the opening is rotatably provided with a dust cover, and the dust cover is provided with a toggle portion abutting against the dust cover when the straw is bent, so as to allow the dust cover to close the opening.

In some implementations, an outer wall of the dust cover is provided with a second rotating shaft, the main lid is provided with a second supporting portion extending to the upper lid, an end portion of the second supporting portion and/or the upper lid is provided with a second mounting groove for the second rotating shaft to be inserted, and a second elastic member forcing the dust cover to open the opening is disposed between the second supporting portion and the dust cover.

In some implementations, an outer wall of the main lid is provided with a buckling groove, and an inner wall of the upper lid is provided with a buckling protrusion buckled in the buckling groove; and/or, the outer wall of the main lid is provided with an anti-rotation groove, and the inner wall of the upper lid is provided with an anti-rotation protrusion inserted in the anti-rotation groove. In some implementations, the main lid or the upper lid is rotatably provided with a carry handle. Compared with the prior art, the lid structure of the present disclosure at least has the following beneficial effects:

The embodiments of the present disclosure disclose the lid structure. The lid structure includes the main lid, the upper lid and the locking assembly, the upper lid is provided with the straw, the upper lid is buckled to the main lid, the upper lid is provided with the opening for the straw to extend out, the locking assembly is disposed between the main lid and the upper lid, and when the straw is bent, the locking assembly is capable of moving along the radial direction of the main lid to be inserted and locked in the inner hole in the end portion of the straw. Specifically, when the straw is bent, the straw is blocked, which can avoid water leakage. Due to the fact that when the straw is bent, the locking assembly is capable of moving along the radial direction of the main lid to be inserted and locked in the inner hole in the end portion of the straw, the straw is prevented from getting upright due to the bouncing force thereof to result in water leakage. In addition, the locking assembly may be moved out of the inner hole in the end portion of the straw when pressed, so that one-button opening for drinking water can be achieved, and by means of the spout portion with this structure, the problem about drinking a large amount of water within a short period of time can be solved. Currently, most of water bottles on the market have small drinking spouts, and wide-mouth water bottles are simply provided with threaded lids. The lid structure of the present disclosure can be applied to the wide-mouth water bottles and is convenient and simple to use, which improves the user experience.

The above description is only an overview of the technical solutions of the present disclosure. In order to more clearly understand the technical means of the present disclosure and implement them in accordance with the contents of the specification, the preferred embodiments of the present disclosure and the accompanying drawings are described in detail as follows.

BRIEF DESCRIPTION OF THE DRAWINGS

In order to more clearly illustrate the technical solutions of the embodiments of the present disclosure, accompanying drawings that are to be referred for description of the embodiments will be briefly described hereinafter. Apparently, the drawings described hereinafter illustrate some embodiments of the present disclosure, and a person of ordinary skill in the art may also derive other drawings based on the drawings described herein without any creative effort.

DESCRIPTION OF REFERENCE NUMERALS

1. main lid; 11. straw; 12. protective structure; 13. first toggle point groove; 14. second toggle point groove; 15. tubular member; 151. first rotating shaft; 152. toggle convex edge; 16. first supporting portion; 161. first mounting groove; 17. second supporting portion; 171. second mounting groove; 18. buckling groove; 19. anti-rotation groove;

2. upper lid; 21. opening; 22. buckling protrusion; 23. anti-rotation protrusion;

3. locking assembly; 31. puller; 32. locking pin; 321. locking hole; 33. first elastic member; 34. first hinge pin; 35. second hinge pin;

4. safety latch; 41. toggle protrusion; 42. toggle point;

5. dust cover; 51. toggle portion; 52. second rotating shaft; 53. second elastic member; 6. carry handle.

DETAILED DESCRIPTION OF THE INVENTION

In order to further explain the technical means and effects adopted by the present disclosure to achieve the intended inventive purpose, the specific implementations, structures, features, and effects according to the present application are described in detail below in connection with the accompanying drawings and preferred embodiments. In the following description, different "an embodiment" or "embodiments" do not necessarily refer to the same embodiment. Furthermore, particular features, structures, or characteristics of one or more embodiments may be combined in any suitable form.

In the description of the present disclosure, it is to be clarified that the terms "first", "second", etc. in the specification and claims of the present disclosure and the above accompanying drawings are used for distinguishing similar objects, and need not be used for describing a particular order or sequence; the terms "vertical", "transverse", "longitudinal", "front", "rear", "left", "right", "upper", "lower", "horizontal" and the like indicate orientation or positional relationships based on those shown in the accompanying drawings, merely for the purpose of facilitating the description of the present disclosure, and do not imply that the device or element referred to must have a characteristic orientation or position, and therefore are not to be construed as a limitation of the present disclosure.

In the description of the present disclosure, it is to be noted that, unless otherwise expressly provided and limited, the terms "mounted", "connected", and "connecting" are to be understood in a broad sense, e.g., it may be a fixed connection or a detachable connection or an integrated connection; it may be a mechanical connection or an electrical connection; it may be a direct connection or an indirect connection through an intermediate medium. The specific meanings of the above terms in the present disclosure may be understood in specific situations by a person of ordinary skill in the art.

Figure 1:
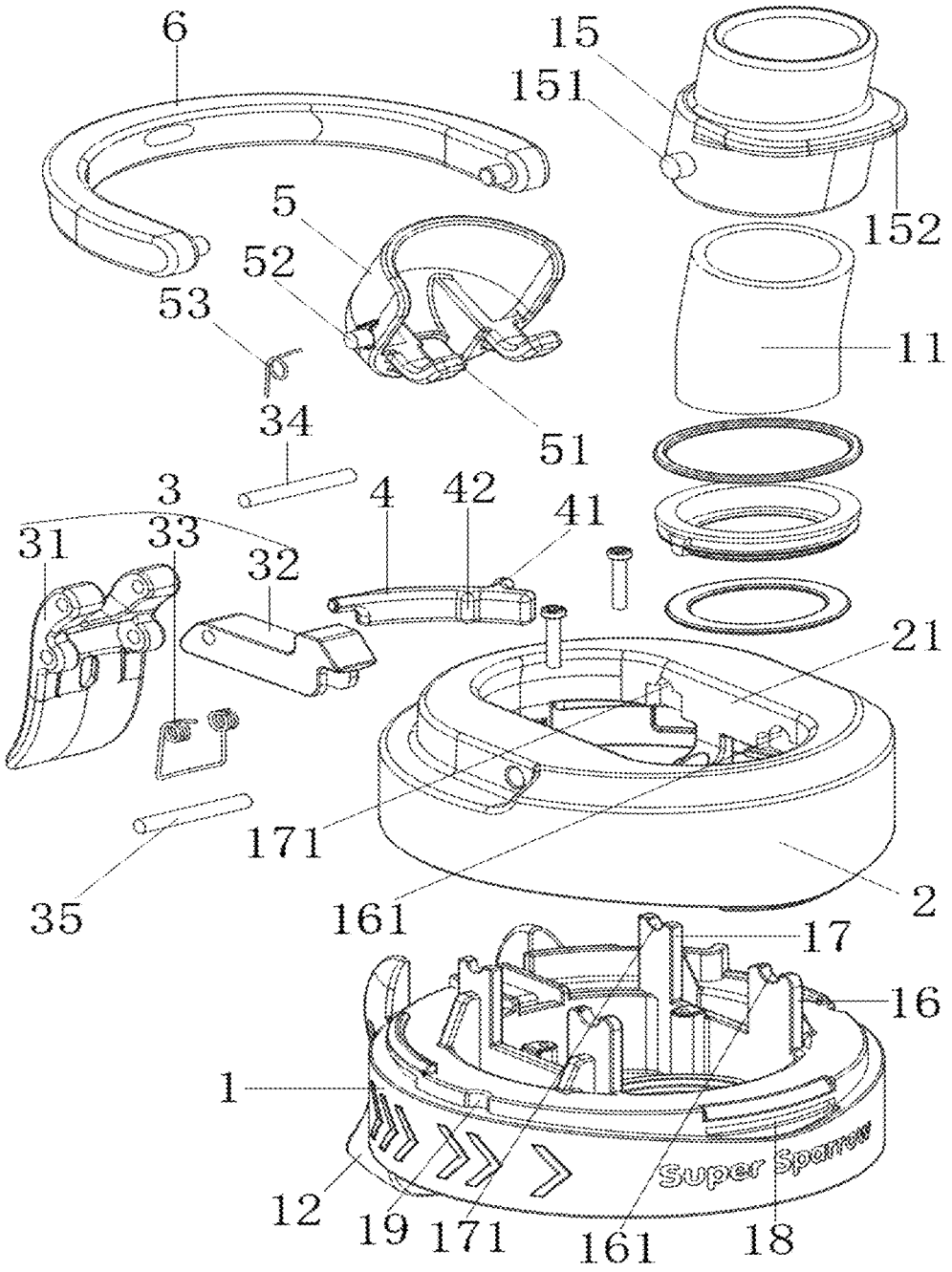
FIG. 1 is a schematic three-dimensional exploded structure diagram of a lid structure according to an embodiment of the present disclosure.
Figure 2:
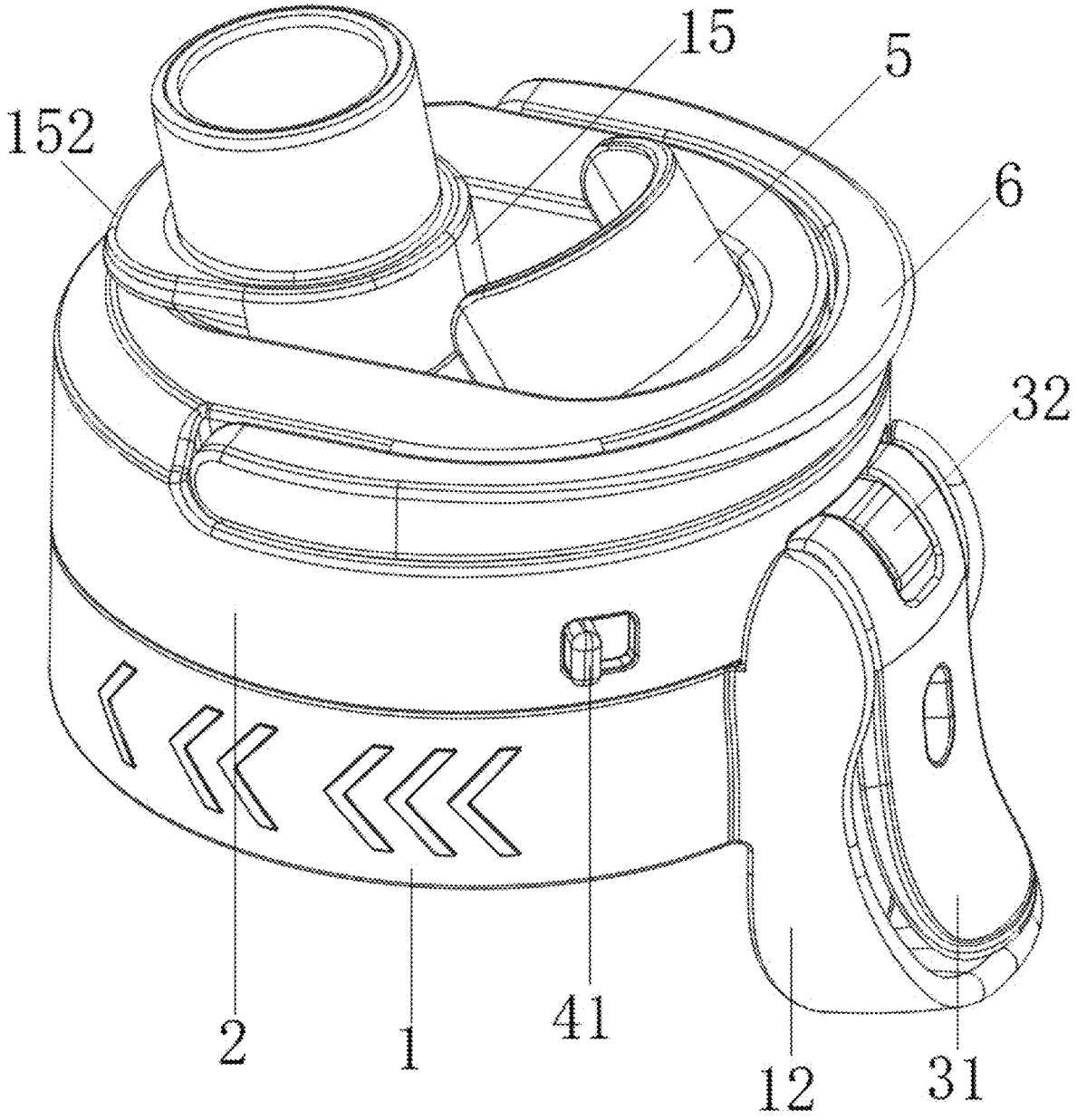
FIG. 2 is a schematic structural diagram of a straw of a lid structure according to an embodiment of the present disclosure when the straw is upright.
Figure 3:
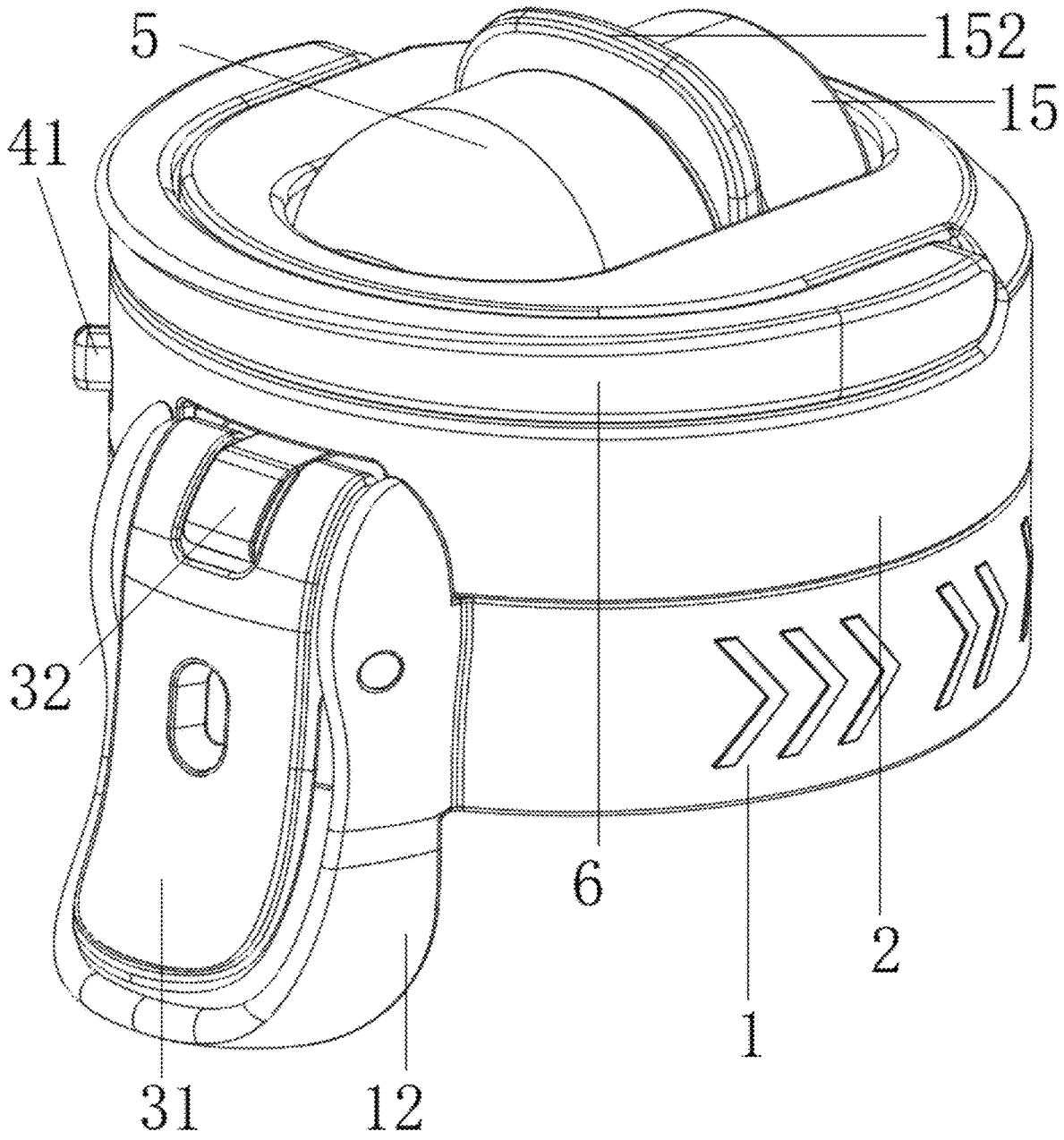
FIG. 3 is a schematic structural diagram of a straw of a lid structure according to an embodiment of the present disclosure when the straw is bent.
Figure 4:
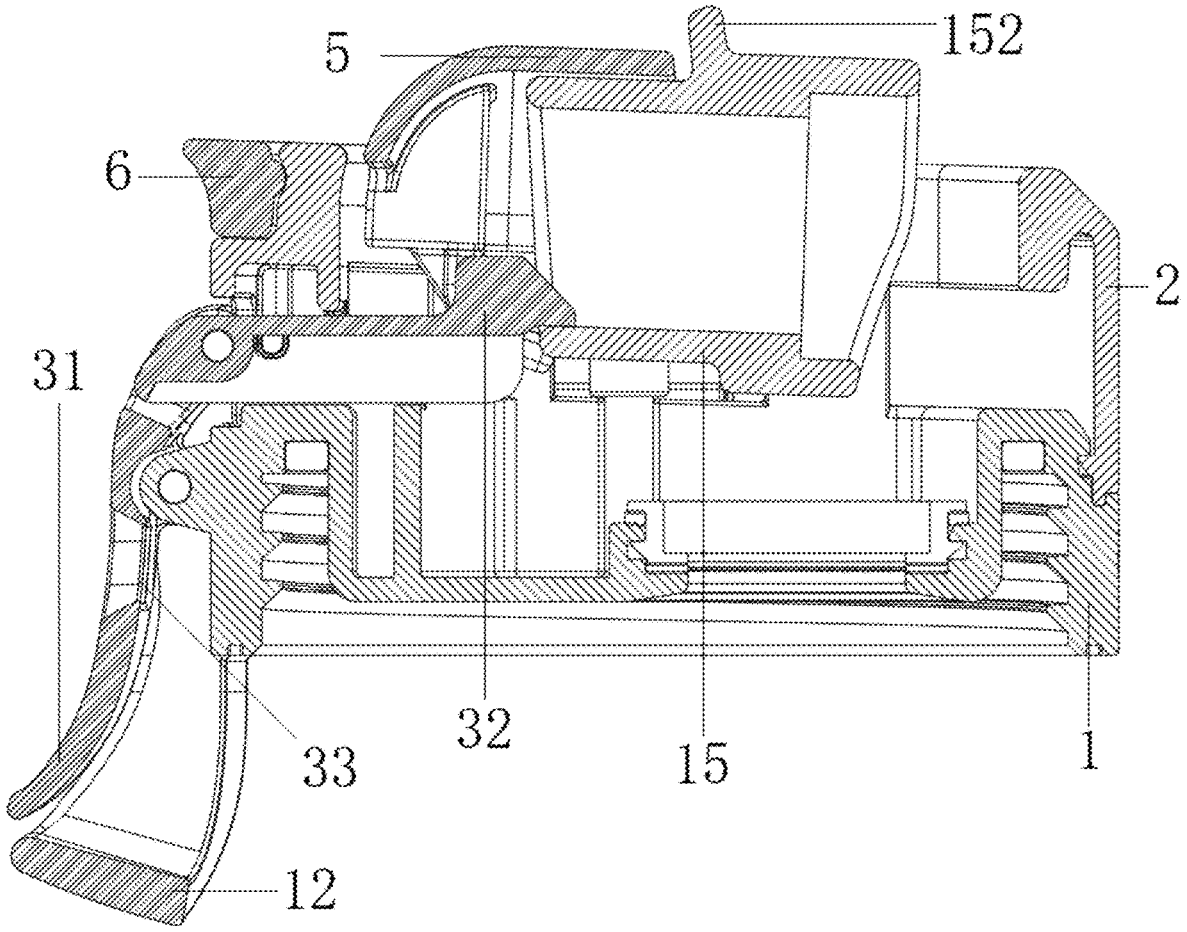
FIG. 4 is a cross-sectional view of a lid structure according to an embodiment of the present disclosure.
Figure 5:
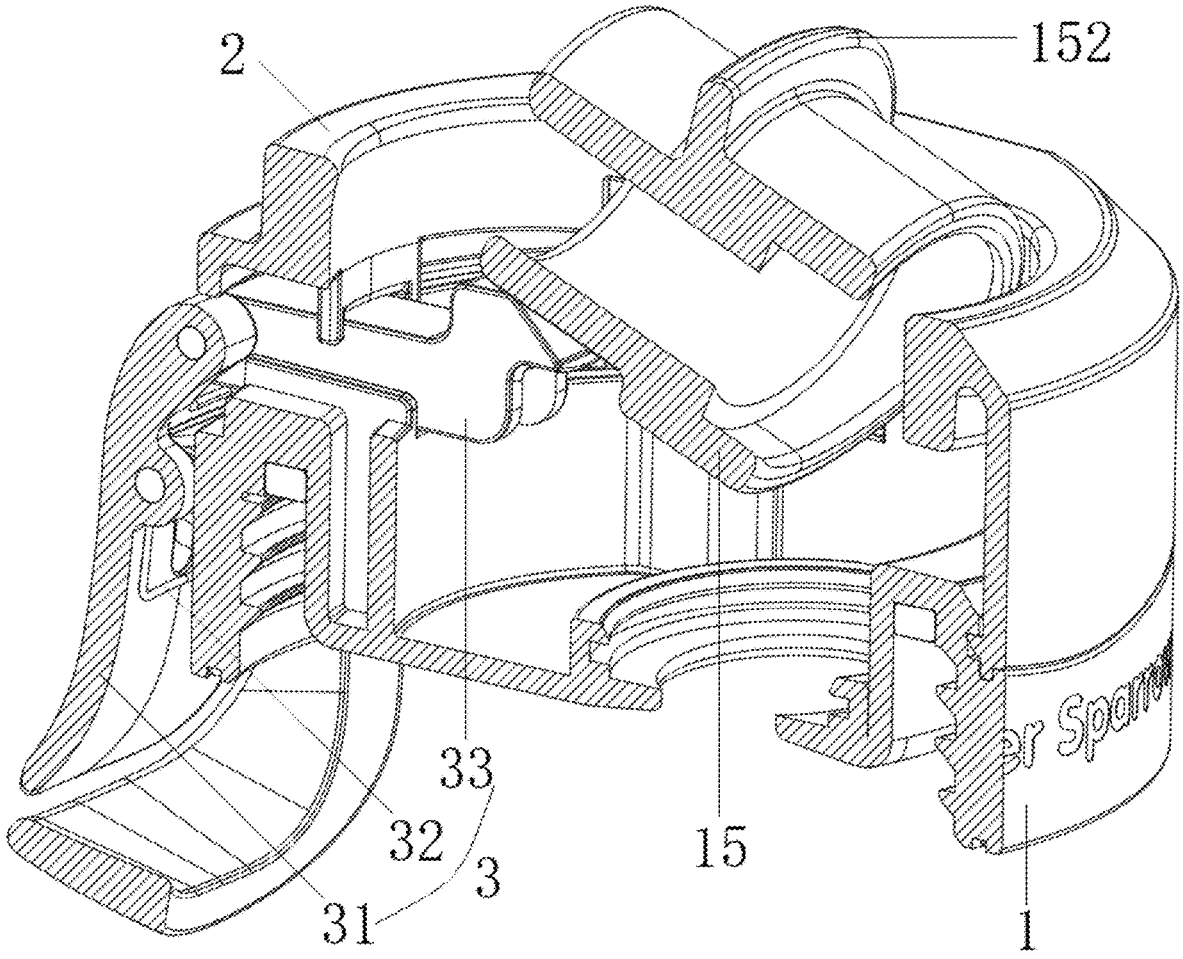
FIG. 5 is a three-dimensional cross-sectional view of a lid structure according to an embodiment of the present disclosure.
Figure 6:
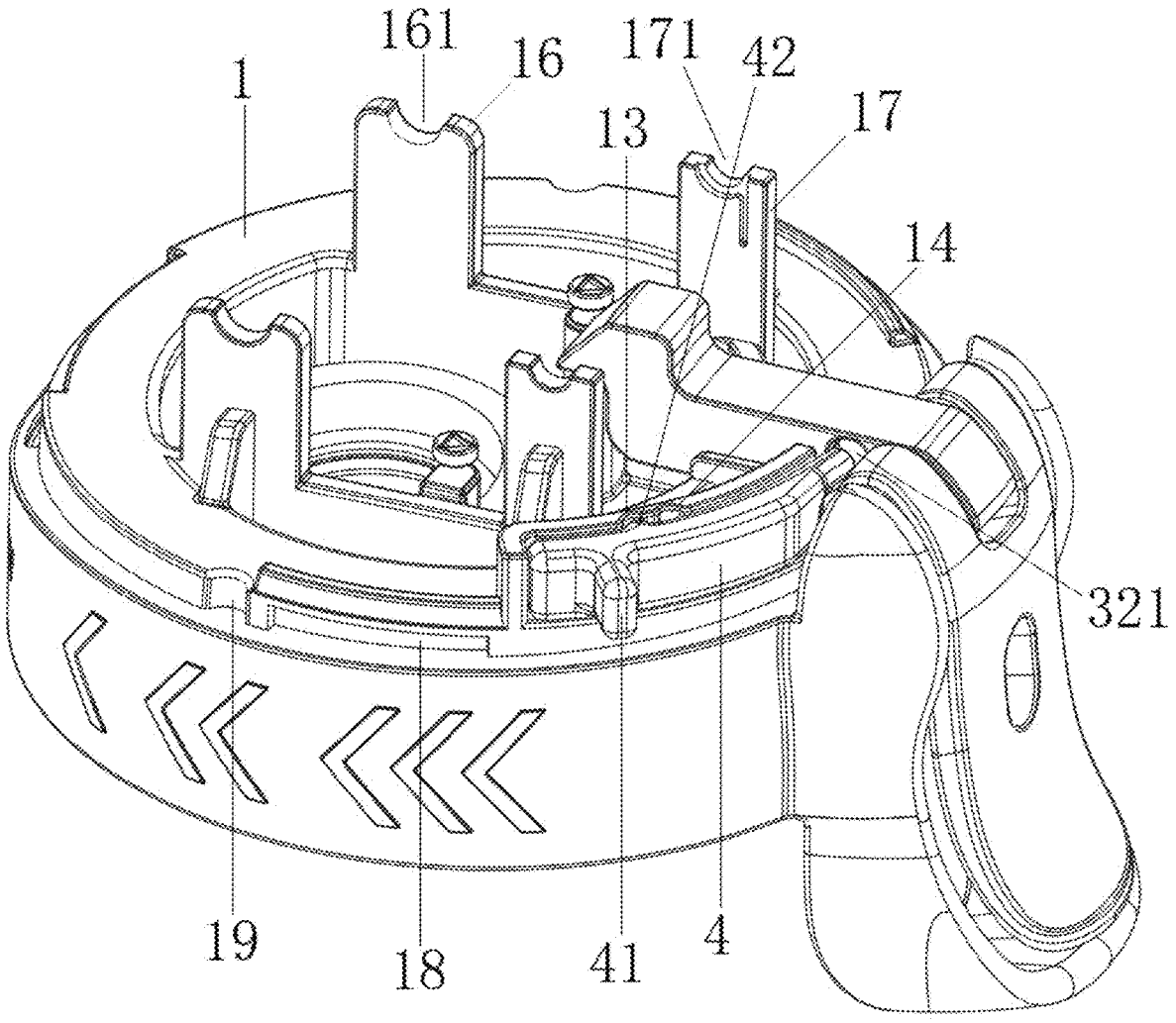
FIG. 6 is a schematic structural diagram of a safety latch being located outside a locking hole of a lid structure according to an embodiment of the present disclosure.
Figure 7:
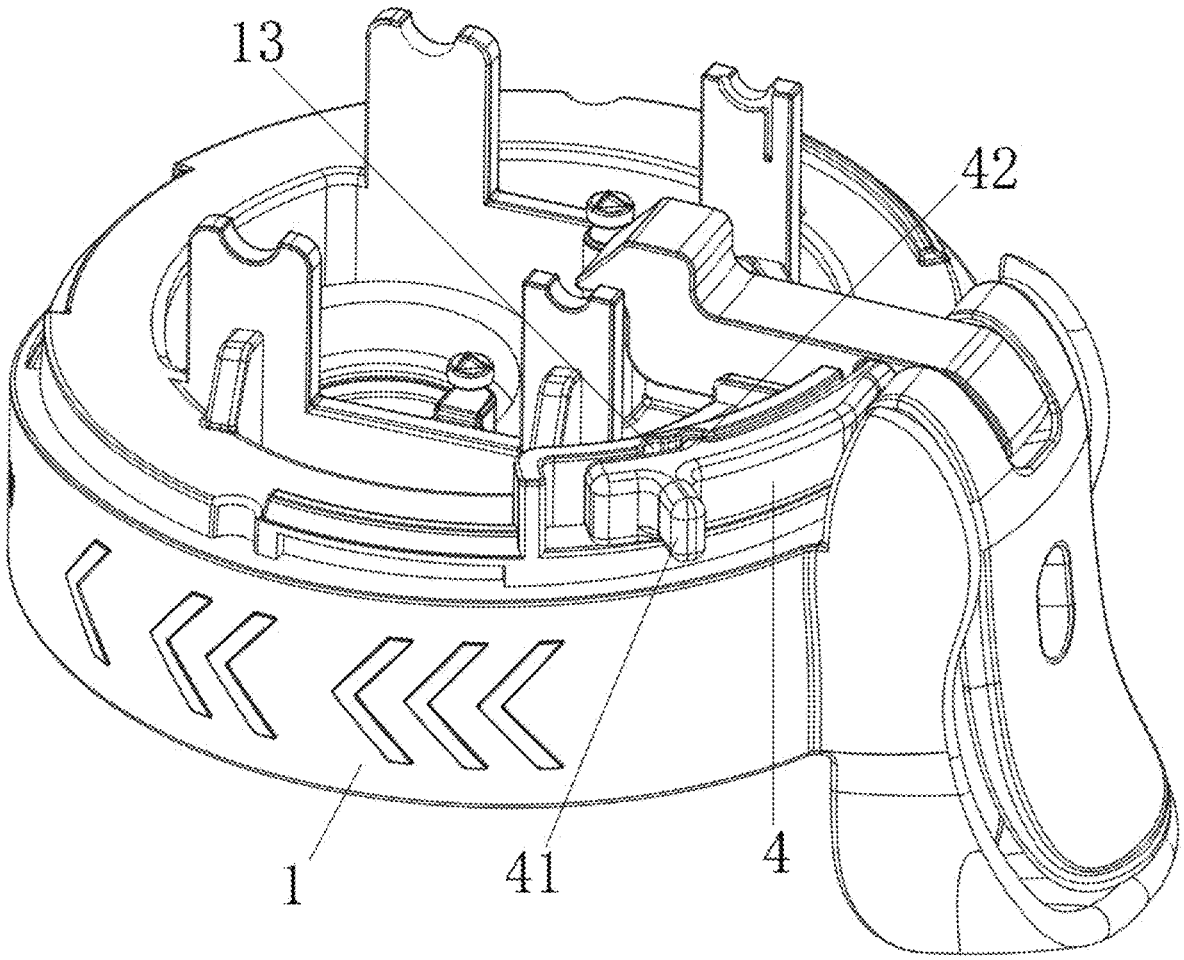
FIG. 7 is a schematic structural diagram of a safety latch being inserted in a locking hole of a lid structure according to an embodiment of the present disclosure.
Figure 8:
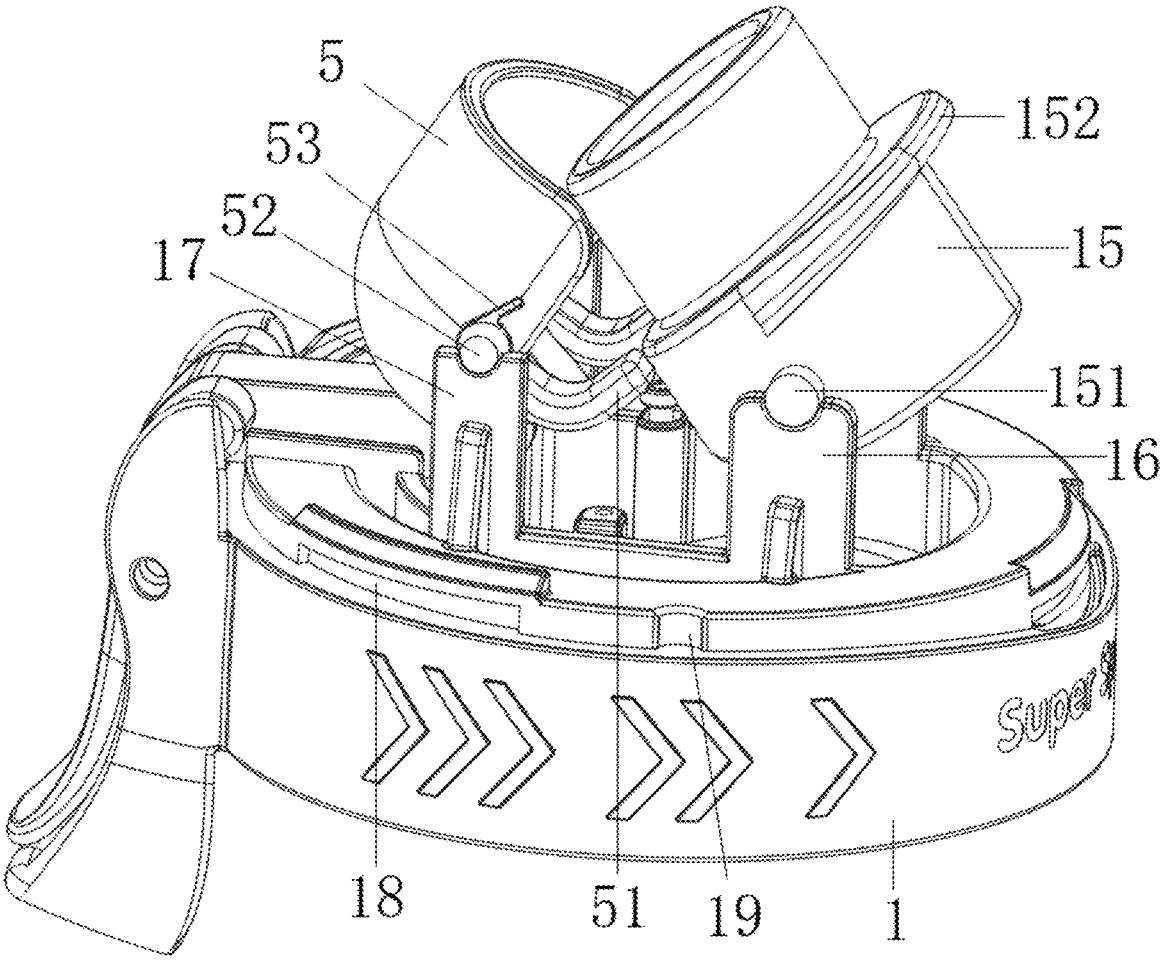
FIG. 8 is a schematic structural diagram of a main lid of a lid structure according to an embodiment of the present disclosure.
Figure 9:
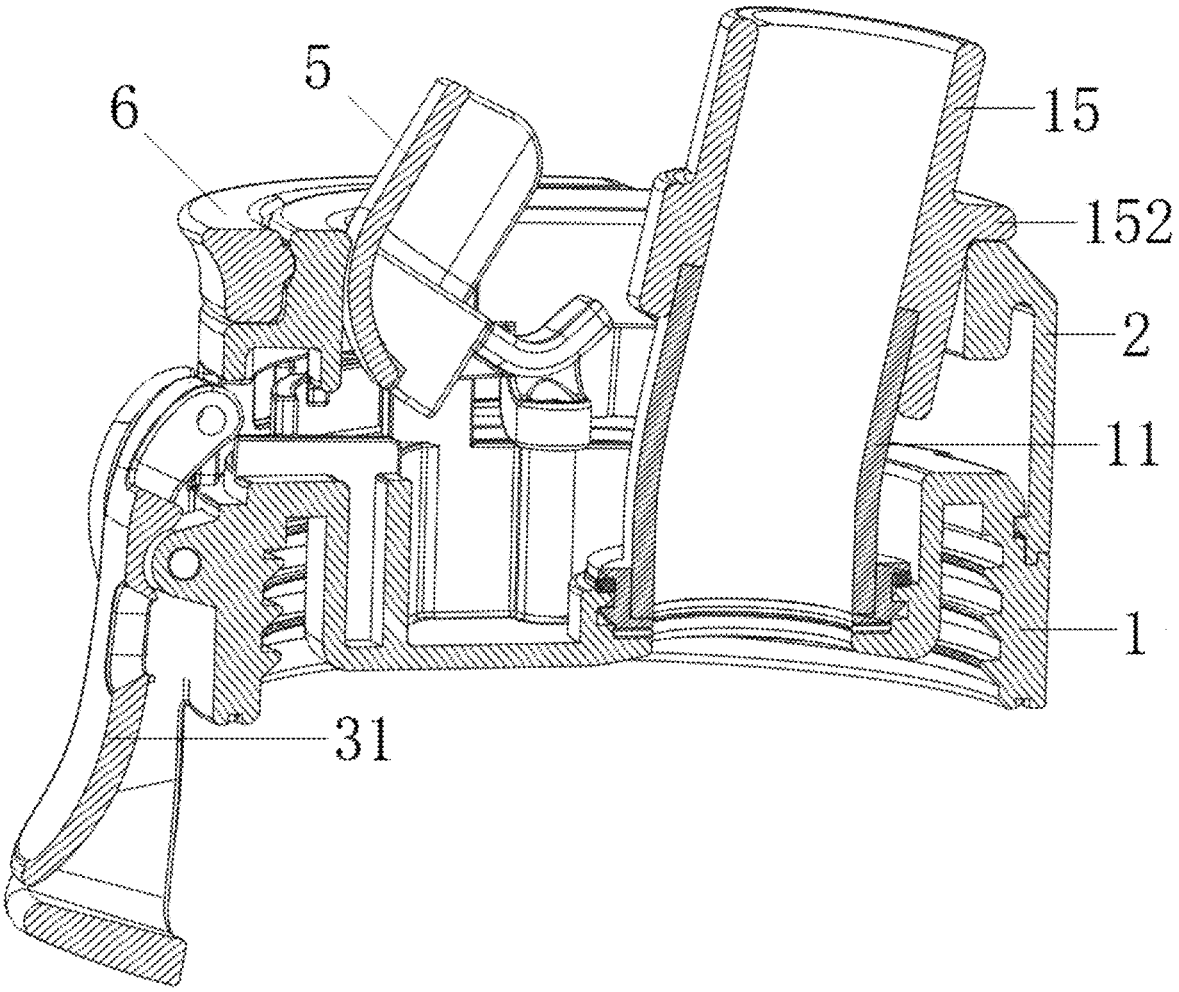
FIG. 9 is a cross-sectional view of a lid structure according to an embodiment of the present disclosure when in another state.
Figure 10:
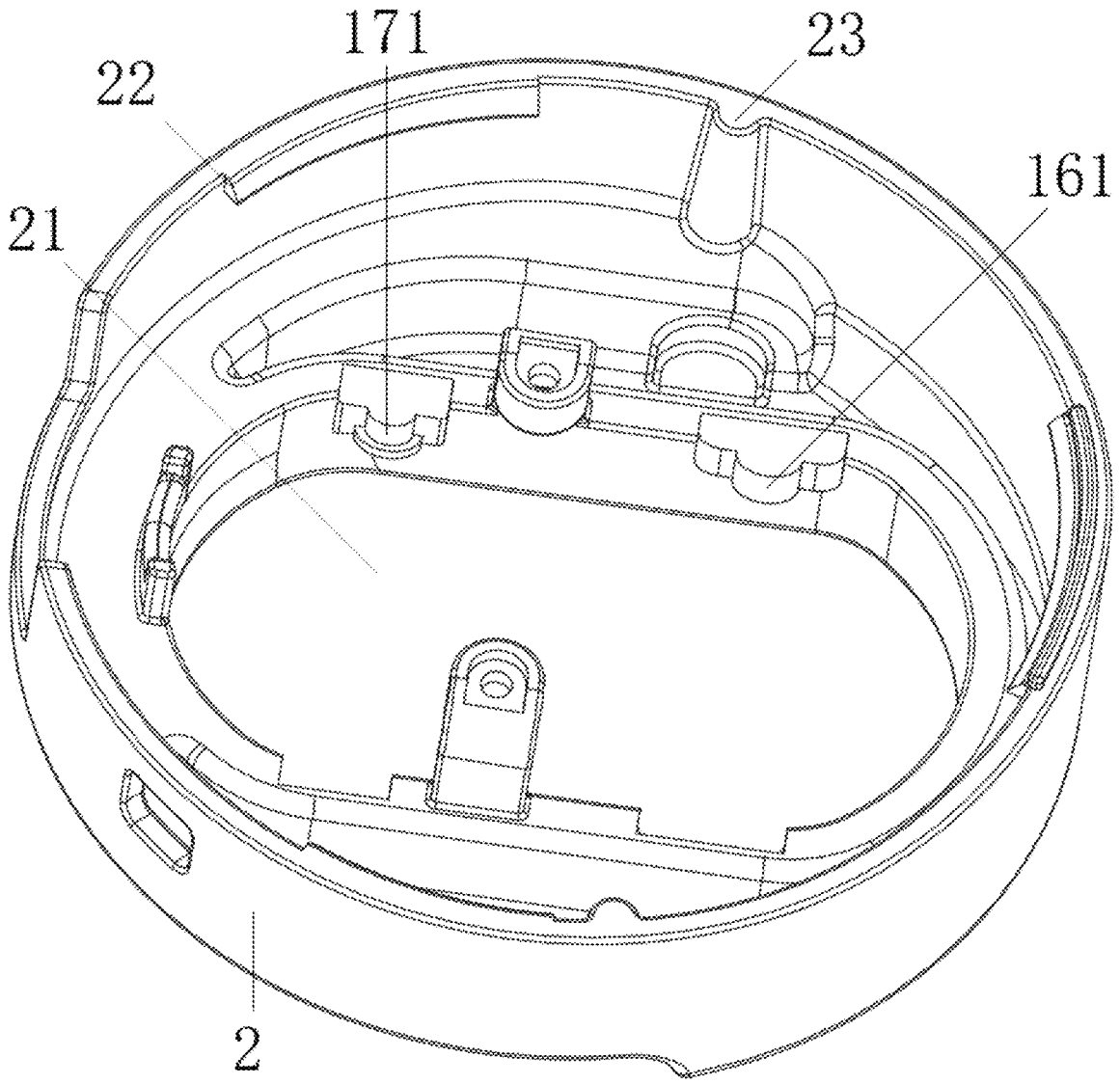
FIG. 10 is a schematic structural diagram of an upper lid of a lid structure according to an embodiment of the present disclosure.

As shown in FIGS. 1-10, an embodiment of the present disclosure provides a lid structure. The lid structure includes:

- a main lid 1 provided with a straw 11;
- an upper lid 2 buckled to the main lid 1, the upper lid 2 being provided with an opening 21 for the straw 11 to extend out; and
- a locking assembly 3 disposed between the main lid 1 and the upper lid 2. When the straw 11 is bent, the locking assembly 3 is capable of moving along a radial direction of the main lid 1 to be inserted and locked in an inner hole in an end portion of the straw 11, and the locking assembly 3 may be moved out of the inner hole in the end portion of the straw 11 when pressed.

In this embodiment, the lid structure includes the main lid 1, the upper lid 2, and the locking assembly 3, the main lid 1 is provided with the straw 11, the upper lid 2 is buckled to the main lid 1, the upper lid 2 is provided with the opening 21 for the straw 11 to extend out, the locking assembly 3 is disposed between the main lid 1 and the upper lid 2, and when the straw 11 is bent, the locking assembly 3 is capable of moving along the radial direction of the main lid 1 to be inserted and locked in the inner hole in the end portion of the straw 11. Specifically, when the straw 11 is bent, the straw 11 is blocked, which may avoid water leakage. In this embodiment, due to the fact that when the straw 11 is bent, the locking assembly 3 is capable of moving along the radial direction of the main lid 1 to be inserted and locked in the inner hole in the end portion of the straw 11, the straw 11 is prevented from getting upright due to the bouncing force thereof to result in water leakage. In addition, the locking assembly 3 may be moved out of the inner hole in the end portion of the straw 11 when pressed, so that one-button opening for drinking water may be achieved, and by means of the spout portion with this structure, the problem about drinking a large amount of water within a short period of time may be solved. Compared to current small drinking cs on the market and wide-mouth water bottles which are simply provided with threaded lids, the lid structure of this embodiment may be applied to the wide-mouth water bottles and is convenient and simple to use, which improves the user experience.

In some implementations, the locking assembly 3 includes a puller 31, a locking pin 32 and a first elastic member 33, the puller 31 is rotatably disposed on an outer wall of the main lid 1, the locking pin 32 is disposed between the main lid 1 and the upper lid 2 in a radially movable manner, one end of the locking pin 32 penetrates out of the main lid 1 and rotatably connected to the puller 31, and the first elastic member 33 is disposed between the puller 31 and the main lid 1 to drive the locking pin 32 to move inward along the radial direction.

In this embodiment, the locking assembly 3 includes the puller 31, the locking pin 32 and the first elastic member 33. The puller 31 is rotatably disposed on the outer wall of the main lid 1, and the puller 31 may be rotatably disposed on the outer wall of the main lid 1 through a second hinge pin 35. The locking pin 32 is disposed between the main lid 1 and the upper lid 2 in a radially movable manner, one end of the locking pin 32 penetrates out of the main lid 1 and rotatably connected to the puller 31, and the locking pin 32 may be rotatably connected to the puller 31 through a first hinge pin 34. The first elastic member 33 is disposed between the puller 31 and the main lid 1 and may drive the locking pin 32 to move inward along the radial direction, so that the locking assembly 3 moves along the radial direction of the main lid 1 when the straw 11 is bent. The locking pin 32 of the locking assembly 3 is inserted and locked in the inner hole in the end portion of the straw 11 to prevent the straw 11 from bouncing to be upright. When the puller 31 is pressed, the puller 31 forces the locking pin 32 to move outward along the radial direction while rotating around the outer wall of the main lid 1, so that the locking pin 32 is moved out of the inner hole in the end portion of the straw 11 to achieve one-button opening for drinking water.

In some implementations, the main lid 1 is provided with a protective structure 12, and the protective structure 12 is disposed around the puller 31; and/or, a safety latch 4 is further disposed between the main lid 1 and the upper lid 2, the safety latch 4 is provided with a toggle protrusion 41 extending out of the upper lid 2, and the locking pin 32 is provided with a locking hole 321 for the safety latch 4 to be inserted and locked when the straw 11 is bent.

In this embodiment, the main lid 1 is provided with a protective structure 12, and the protective structure 12 is disposed around the puller 31, so that the problem that when the puller 31 is touched by mistake, the locking pin 32 is moved out of the inner hole in the end portion of the straw 11 to cause water leakage may be avoided.

The safety latch 4 is further disposed between the main lid 1 and the upper lid 2, the safety latch 4 is provided with the toggle protrusion 41 extending out of the upper lid 2, and the locking pin 32 is provided with the locking hole 321 for the safety latch 4 to be inserted and locked when the straw 11 is bent. By inserting and locking the safety latch 4 in the locking hole 321, the problem that when the puller 31 is touched by mistake, the locking pin 32 is moved out of the inner hole in the end portion of the straw 11 to cause water leakage may be avoided.

In some implementations, the safety latch 4 is provided with a toggle point 42, the main lid 1 is provided with a first toggle point groove 13 and a second toggle point groove 14, the toggle point 42 is located in the first toggle point groove 13 when the safety latch 4 is withdrawn from the locking hole 321, and the toggle point 42 is located in the second toggle point groove 14 when the safety latch 4 is inserted in the locking hole 321.

In this embodiment, the cooperation of the toggle point 42 with the first toggle point groove 13 and the second toggle point groove 14 may facilitate people to recognize the position, and at the same time, the hand feeling is improved. In addition, the problem that the safety latch 4 withdraws from the locking hole 321 due to shaking and other reasons to result in water leakage may also be avoided.

In some implementations, a tubular member 15 is disposed at the end portion of the straw 11, a first rotating shaft 151 is disposed on an outer wall of the tubular member 15, the main lid 1 is provided with a first supporting portion 16 extending to the upper lid 2, an end portion of the first supporting portion 16 and/or the upper lid 2 is provided with a first mounting groove 161 for the first rotating shaft 151 to be inserted, and when the straw 11 is bent, the locking pin 32 is able to be inserted and locked in an inner hole in an end portion of the tubular member 15.

In this embodiment, through cooperation of the first rotating shaft 151 of the tubular member 15 and the end of the first supporting portion 16 of the main lid 1 and/or the first mounting groove 161 of the upper lid 2, the tubular member 15 is rotatably disposed between the main lid 1 and the upper lid 2, and when the straw 11 is bent, the locking pin 32 may be inserted and locked in the inner hole in the end portion of the tubular member 15 to avoid the phenomenon of water leakage caused by easy deformation of the straw 11 when the straw 11 is bent, and the sealing effect is improved. The tubular member 15 is made of a hard material.

In some implementations, a toggle convex edge 152 protruding outward in a radial direction is disposed on an outer wall of the tubular member 15 away from the locking assembly 3, and the toggle convex edge 152 is located outside the opening 21.

In this embodiment, the toggle convex edge 152 is provided to facilitate rotation of the tubular member 15.

In some implementations, a dust cover 5 is rotatably disposed at the opening 21, and the dust cover 5 is provided with a toggle portion 51 abutting against the dust cover when the straw 11 is bent, so as to force the dust cover 5 to close the opening 21.

In this embodiment, the dust cover 5 is provided with the toggle portion 51 abutting against the dust cover when the straw 11 is bent, so as to force the dust cover 5 to close the opening 21. With this structure, the opening 21 may be closed automatically when the straw 11 is bent, so that the straw 11 is hidden in the dust cover 5 to avoid entry of dust and the like.

By providing the tubular member 15, the toggle portion 51 of the dust cover 5 may abut against the tubular member 15 when the straw 11 is bent, so as to force the dust cover 5 to close the opening 21, and the straw 11 is hidden in the dust cover 5 to avoid entry of dust and the like.

In some implementations, an outer wall of the dust cover 5 is provided with a second rotating shaft 52, the main lid 1 is provided with a second supporting portion 17 extending to the upper lid 2, an end portion of the second supporting portion 17 and/or the upper lid 2 is provided with a second mounting groove 171 for the second rotating shaft 52 to be inserted, and a second elastic member 53 forcing the dust cover 5 to open the opening 21 is disposed between the second supporting portion 17 and the dust cover 5.

In this embodiment, due to the cooperation of the second rotating shaft 52 of the dust cover 5 and the end portion of the second supporting portion 17 of the main lid 1 and/or the second mounting groove 171 of the upper lid 2, the dust cover 5 may be rotatably fixed between the main lid 1 and the upper lid 2. In addition, the second elastic member 53 that forces the dust cover 5 to open the opening 21 is disposed between the second supporting portion 17 and the dust cover 5, and the dust cover 5 is opened automatically through the second elastic member 53 when the straw 11 bounces to be upright.

In some implementations, an outer wall of the main lid 1 is provided with a buckling groove 18, and an inner wall of the upper lid 2 is provided with a buckling protrusion 22 buckled in the buckling groove 18; and/or, the outer wall of the main lid 1 is provided with an anti-rotation groove 19, and the inner wall of the upper lid 2 is provided with an anti-rotation protrusion 23 inserted in the anti-rotation groove 19.

In this embodiment, the outer wall of the main lid 1 is provided with the buckling groove 18, the inner wall of the upper lid 2 is provided with the buckling protrusion 22 buckled in the buckling groove 18, and the upper lid 2 is buckled to the main lid 1 through buckling of the buckling groove 18 and the buckling protrusion 22.

The outer wall of the main lid 1 is provided with the anti-rotation groove 19, and the inner wall of the upper lid 2 is provided with the anti-rotation protrusion 23 inserted in the anti-rotation groove 19. Through cooperation of the anti-rotation groove 19 and the anti-rotation protrusion 23, circumferential rotation between the main lid 1 and the upper lid 2 is prevented, and the buckling groove 18 is prevented from disengaged from the buckling protrusion 22.

In some implementations, the main lid 1 or the upper lid 2 is rotatably provided with a carry handle 6.

In this embodiment, two ends of the carry handle 6 are rotatably disposed on the outer wall of the main lid 1 or the upper lid 2, which facilitates carrying.

An embodiment of present disclosure further provides a water bottle. The water bottle includes the lid structure as described above.

The drinking spout of the lid structure of this embodiment may be a wide drinking spout, and the wide drinking spout is large in flow and may be applied to a wide-mouth water bottle.

In summary, it is readily understood by those skilled in the art that the above advantageous technical features can be freely combined and superimposed without conflicts.

The above description is merely specific implementations of the present disclosure, and is not intended to limit the scope of protection of the present disclosure. All equivalent modifications or substitutions which may be easily conceived by those skilled in the art within the technical scope disclosed by the present disclosure shall fall within the scope of protection of the present disclosure. Therefore, the scope of protection of the present disclosure shall be based on the scope of protection of the claims.

The invention claimed is:

1. A lid structure, comprising:

a main lid (1) provided with a straw (11);

an upper lid (2) buckled to the main lid (1), the upper lid (2) being provided with an opening (21) for the straw (11) to extend out; and a locking assembly (3) disposed between the main lid (1) and the upper lid (2), wherein when the straw (11) is bent, the locking assembly (3) is capable of moving along a radial direction of the main lid (1) to be inserted and locked in an inner hole in an end portion of the straw (11), and the locking assembly (3) is moved out of the inner hole in the end portion of the straw (11) when pressed;

wherein the locking assembly (3) comprises a puller (31), a locking pin (32) and a first elastic member (33), the puller (31) is rotatably disposed on an outer wall of the main lid (1), the locking pin (32) is disposed between the main lid (1) and the upper lid (2) in a radially movable manner, one end of the locking pin (32) penetrates out of the main lid (1) and rotatably connected to the puller (31), and the first elastic member (33) is disposed between the puller (31) and the main lid (1) to drive the locking pin (32) to move inward along the radial direction.

2. The lid structure according to claim 1, wherein the main lid (1) is provided with a protective structure (12), and the protective structure (12) is disposed around the puller (31);

and/or, a safety latch (4) is further disposed between the main lid (1) and the upper lid (2), the safety latch (4) is provided with a toggle protrusion (41) protruding out of the upper lid (2), and the locking pin (32) is provided with a locking hole (321) for the safety latch (4) to be inserted and locked when the straw (11) is bent.

3. The lid structure according to claim 2, wherein the safety latch (4) is provided with a toggle point (42), the main lid (1) is provided with a first toggle point groove (13) and a second toggle point groove (14), the toggle point (42) is located in the first toggle point groove (13) when the safety latch (4) is withdrawn from the locking hole (321), and the toggle point (42) is located in the second toggle point groove (14) when the safety latch (4) is inserted in the locking hole (321).

4. The lid structure according to claim 1, wherein a tubular member (15) is disposed at the end portion of the straw (11), a first rotating shaft (151) is disposed on an outer wall of the tubular member (15), the main lid (1) is provided with a first supporting portion (16) extending to the upper lid (2), an end portion of the first supporting portion (16) and/or the upper lid (2) is provided with a first mounting groove (161) for the first rotating shaft (151) to be inserted, and when the straw (11) is bent, the locking pin (32) is able to be inserted and locked in an inner hole in an end portion of the tubular member (15).

5. The lid structure according to claim 4, wherein a toggle convex edge (152) protruding outward in a radial direction is disposed on an outer wall of the tubular member (15) away from the locking assembly (3), and the toggle convex edge (152) is located outside the opening (21).

6. The lid structure according to claim 1, wherein the opening (21) is rotatably provided with a dust cover (5), and the dust cover (5) is provided with a toggle portion (51) abutting against the dust cover when the straw (11) is bent, so as to allow the dust cover (5) to close the opening (21).

7. The lid structure according to claim 6, wherein an outer wall of the dust cover (5) is provided with a second rotating shaft (52), the main lid (1) is provided with a second supporting portion (17) extending to the upper lid (2), an end portion of the second supporting portion (17) and/or the upper lid (2) is provided with a second mounting groove (171) for the second rotating shaft (52) to be inserted, and a second elastic member (53) forcing the dust cover (5) to open the opening (21) is disposed between the second supporting portion (17) and the dust cover (5).

8. The lid structure according to claim 1, wherein an outer wall of the main lid (1) is provided with a buckling groove (18), and an inner wall of the upper lid (2) is provided with a buckling protrusion (22) buckled in the buckling groove (18); and/or, the outer wall of the main lid (1) is provided with an anti-rotation groove (19), and the inner wall of the upper lid (2) is provided with an anti-rotation protrusion (23) inserted in the anti-rotation groove (19).

9. The lid structure according to claim 1, wherein the main lid (1) or the upper lid (2) is rotatably provided with a carry handle (6).

* * * * *